US007176169B2

(12) United States Patent
Gibb et al.

(10) Patent No.: US 7,176,169 B2
(45) Date of Patent: Feb. 13, 2007

(54) REFRIGERATOR LUBRICANT COMPOSITIONS

(75) Inventors: Peter Timothy Gibb, Guisborough (GB); David William Graham, Billingham (GB)

(73) Assignee: Imperial Chemical Industries PLC, London (GB)

( * ) Notice: Subject to any disclaimer, the term of this patent is extended or adjusted under 35 U.S.C. 154(b) by 246 days.

(21) Appl. No.: 10/647,531

(22) Filed: Aug. 26, 2003

(65) Prior Publication Data

US 2004/0063590 A1 Apr. 1, 2004

Related U.S. Application Data

(63) Continuation of application No. PCT/GB02/00866, filed on Feb. 27, 2002.

(30) Foreign Application Priority Data

Mar. 1, 2001 (GB) ..... 0105065.7

(51) Int. Cl.
*C10M 105/06* (2006.01)
*C10M 129/74* (2006.01)
*C09K 5/00* (2006.01)

(52) U.S. Cl. ..... 508/485; 252/67; 252/68

(58) Field of Classification Search ..... 252/67, 252/68; 508/485
See application file for complete search history.

(56) References Cited

U.S. PATENT DOCUMENTS

| | | | | |
|---|---|---|---|---|
| 3,909,432 | A | 9/1975 | McGuire et al. | |
| 5,342,533 | A * | 8/1994 | Kondo et al. | 252/68 |
| 5,554,311 | A * | 9/1996 | Katafuchi et al. | 252/68 |
| 5,653,909 | A * | 8/1997 | Muraki et al. | 252/68 |
| 5,705,086 | A * | 1/1998 | Ardito et al. | 252/68 |
| 5,866,030 | A * | 2/1999 | Reyes-Gavilan et al. | 252/68 |
| 6,251,300 | B1 * | 6/2001 | Takigawa et al. | 252/67 |
| 6,656,891 | B1 * | 12/2003 | Sakanoue et al. | 508/579 |

FOREIGN PATENT DOCUMENTS

| | | |
|---|---|---|
| EP | 0556662 A1 | 8/1993 |
| EP | 0699742 A2 | 3/1996 |
| JP | 62292895 | 12/1987 |
| JP | 5125374 | 5/1993 |

* cited by examiner

*Primary Examiner*—Ellen M. McAvoy
(74) *Attorney, Agent, or Firm*—Jones Day

(57) ABSTRACT

A lubricant composition for use in a rotary vane compressor has a base oil component that comprises an alkylbenzene as a major component thereof and a polyol ester as a minor component thereof. In particular, the base oil component comprises at least 55% by weight of alkylbenzene and at most 45% by weight of a polyol ester, more preferably between 55% and 75% by weight of alkylbenzene and between 45% and 25% by weight of polyol ester and, especially, between 60% and 75% by weight of alkyl benzene and between 45% and 25% by weight of polyol ester.

33 Claims, 2 Drawing Sheets

REFRIGERATOR LUBRICANT COMPOSITIONS

CROSS REFERENCE TO RELATED APPLICATION

This application is a continuation application based on International Application No. PCT/GB02/00866, filed Feb. 27, 2002, which designates the United States. This application, in its entirety, is incorporated herein by reference.

The invention relates to lubricant compositions for refrigerant applications, especially lubricant compositions for use in rotary vane compressors used in refrigeration equipment, and to compressors, especially rotary vane compressors, lubricated by such compositions.

Refrigeration systems consist of a compressor for compressing a refrigerant gas, a condenser for condensing the compressed gas, an expansion device and an evaporator section in which the condensed gas is evaporated to provide a cooling effect, the evaporator section being connected by a return line to the compressor. The compressor, in having moving parts, requires lubrication to reduce friction and wear and to provide, in some designs, a sealing effect.

Historically, lubricant compositions used in refrigeration systems contained, as a base oil, mineral oils, alkylbenzenes, paraffinic oils, naphthalenic oils and poly α olefins (PAOs), the refrigerant typically being chlorofluorocarbons (CFCs) and hydra chlorofluorocarbons (HCFCs). However, following the Montreal Protocol, in 1987, owing to the ozone-depletion properties of such refrigerants, CFCs, and subsequently HCFCs, were to be phased out.

The introduction of alternative refrigerants introduced included fluorocarbons (FCs) and hydrofluorocarbons (HFCs). However, traditional refrigerant lubricant compositions such as mineral oils and alkylbenzenes, owing to their immiscibility with the new refrigerants, were not considered to be adequate for these applications. For example, such traditional lubricants suffer from oil return problems and create high torque in the motor at start-up owing to their high viscosity when cold. Lubricant compositions considered suitable for use with the new refrigerants, owing to their higher polarity and hence greater miscibility with the new refrigerants, included polyol esters (POEs), polyvinylethers (PVEs) and polyalkyleneglycols (PAGs).

However, the high loads generated by the vane on the compression elements in rotary vane compressors used in refrigeration applications create a difficult environment for compressors containing such lubricant compositions to operate in. Typically, some lubricant compositions do not perform adequately leading to significant wear of the vanes and the compression elements in the compressors. For example, POEs, owing to their solubility in the refrigerant and low viscosity pressure coefficient are not able to maintain sufficient viscosity under operating conditions to prevent metal to metal contact and wear. Additionally, owing to the heat generated at the tips of the vanes, some lubricant compositions can break down into undesirable decomposition products, for example POEs can degrade to acids, which can lead to corrosion and other deleterious affects.

Attempts have been made to overcome these problems.

For example, in EP 0533957, a fixed-vane rotary compressor used in a refrigeration system containing 1,1,1,2-tetrafluoroethane (R134a), an HFC, and a lubricant composition consisting of a POE, the vane is made of a material having a hardness and melting point higher than the material from which the compression element is made.

A similar compressor is disclosed in U.S. Pat. No. 5,966,949. However, in that instance, the POE lubricant composition also contains an extreme pressure additive such as phosphoric acid triester.

PVEs have found particular utility in rotary vane compressors but are expensive relative to other lubricant compositions.

More generally, attempts have been made to use the traditional lubricant compositions including mineral oil, alkylbenzenes etc with the new refrigerant gases.

For example, in EP 0622445, it is proposed to use a mixture of fluorine-containing refrigerant gases at least one of which is inflammable, the mixture being non-flammable, in combination with a lubricant composition which, under the working conditions of the refrigeration system, has a solubility in the refrigerant gas mixture of 0.5 to 7% by weight. The refrigerant gas mixture is selected from HFCs, fluoroamine, fluoroether, fluoropropane, fluoroethane and fluorosilane. The lubricant composition may be selected from a chlorofluorocarbon polymer, a perfluorocarbon polymer, perfluoroalkylpolyether, a modified silicone or a chlorinated aromatic compound or from alkylbenzenes, poly α olefins, paraffinic oils, naphthalenic oils, polyphenylene ethers, polyphenylenethioethers and chlorinated paraffins.

In EP 1018538, it is proposed to use hydrocarbon oil as the base oil for the lubricant composition with a refrigerant that contains hydrocarbon. Possible refrigerants include inter alia methane, ethylene, ethane, propylene, propane, butane either alone or in mixtures with one another or with an HFC. Possible lubricant compositions contain a base oil of naphthalenic mineral oils, paraffinic mineral oils, olefin polymers, naphthalene compounds, alkylbenzenes and mixtures thereof.

However, owing to the low solubility of such traditional lubricant compositions in HFCs, there still remain issues of oil return from the refrigeration system and start-up problems owing to the high viscosity of such compositions at relatively low temperatures.

It is an object of the present invention to provide a lubricant composition that reduces or obviates one or more of the aforementioned disadvantages.

According to the present invention, a lubricant composition for use in a rotary vane compressor has a base oil component that comprises an alkylbenzene as a major component thereof and a polyol ester as a minor component thereof.

In particular, the base oil component of the lubricant composition comprises at least 55% by weight of alkylbenzene and at most 45% by weight of a polyol ester; more preferably between 55% and 75% by weight of alkylbenzene and between 45% and 25% by weight of polyol ester and, especially, between 60% and 75% by weight of alkylbenzene and between 45% and 25% by weight of polyol ester. More especially, the base oil component of the lubricant composition consists essentially of alkylbenzene and polyol ester.

Alkylbenzenes and polyol esters and their preparation are described in Synthetic Lubricants and High-Performance Functional Fluids ($1^{st}$ Edition Edited by Ronald L Shubkin, 1993, ISBN 0-8247-8715-3; $2^{nd}$ Edition Edited by Leslie R Rudnick and Ronald L Shubkin, 1999, 0-8247-0194-1). Particular reference is made to Part I, Sections 2 and 5 and Part II, Section 19 of the $1^{st}$ Edition and to Part I, Sections 3 and 7 and Part II, Sections 24 and 25 of the $2^{nd}$ Edition.

Alkylbenzenes particularly suitable for use in the invention include mono-alkylbenzenes, di-alkyl benzenes, di-phenylalkanes and mixtures thereof. Preferably, the alkyl component of the alkylbenzene is branched and is derived from propylene oligomers.

Preferred alkylbenzenes for use in the invention have a molecular distribution in which at least 80%, and more especially, 100% of the molecular weight fraction is greater than 200; more particularly, at least 75% of the molecular weight fraction is greater than 300; and especially at least 40%, more particularly 50%, of the molecular weight fraction is greater than 350. Preferably, at least 70% of the molecular weight fraction is below 500, more especially at least 50% of the molecular weight fraction is below 450.

Preferred alkylbenzenes have a kinematic viscosity of at least 10 cSt, and more preferably at least 25 cSt, but not more than 70 cSt at 40° C. and a kinematic viscosity of at least 2 cSt, and more preferably at least 3.5 cSt, but not more than 10 cSt at 100° C.

Preferred alkylbenzenes have a pour point of less than −10° C. more preferably less than −20° C. and particularly less than −30° C.

Preferred alkylbenzenes have an acid number of less than 0.04 mgKOH/g.

Polyol esters particularly suitable for use in the invention are made from polyhydric alcohols and monobasic carboxylic acids. Particularly preferred polyol esters are made from one or more alcohols selected from neopentylglycol (NPG), trimethylol-propane (TMP) and pentaerythritol (PE) and dimers and trimers thereof and one or more acids selected from linear and/or branched $C_5$ to $C_{18}$ acids, particularly $C_5$ to $C_{13}$ acids and more particularly $C_5$ to $C_9$ acids.

Preferred polyol esters have a kinematic viscosity of at least 5 cSt but not more than 40 cSt and more preferably less than 25 cSt at 40° C. and a kinematic viscosity of at least 1.5 cSt but not more than 5 cSt and more preferably less than 4 cSt, at 100° C.

Preferred polyol esters have a pour point of less than −40° C. more preferably less than −50° C. and particularly less than −55° C.

Preferred polyol esters have an acid number of less than 0.04 mgKOH/g.

Preferred lubricant compositions according to the invention have a kinematic viscosity of at least 5 cSt but not more than 40 cSt and more preferably less than 25 cSt at 40° C. and a kinematic viscosity of at least 2 cSt but not more than 6 cSt and more preferably less than 5 cSt, at 100° C.

Such preferred lubricant compositions have a pour point of not more than −40° C., preferably not more than 45° C. and especially not more than −50° C.

Lubricant compositions according to the invention also comprise one or more other lubricant additives of known functionality at levels between 0.0001 and 20 weight %, more preferably between 0.01 and 10 weight % more especially between 0.01 and 5 weight % based on the weight of the base oil component. Suitable additives include antioxidants, antiwear additives, extreme pressure agents, acid scavengers, foaming agents, anti-foaming agents, stabilisers, surfactants, viscosity index improvers, corrosion inhibitors, metal deactivators or passivators, lubricity improvers or oiliness agents and friction modifiers.

According to another aspect of the invention, the use in a rotary vane compressor of a lubricant composition having a base oil component that comprises an alkylbenzene as a major component thereof and a polyol ester as a minor component thereof.

According to yet another aspect of the invention, a method of lubricating a rotary vane compressor comprises utilising a lubricant composition having a base oil component that comprises an alkylbenzene as a major component thereof and a polyol ester as a minor component thereof.

According to a further aspect of the invention, a rotary vane compressor charged with a lubricant composition having a base oil component that comprises an alkylbenzene as a major component thereof and a polyol ester as a minor component thereof.

According to a still further aspect of the invention, a refrigeration system comprising a rotary vane compressor, said system being charged with a refrigerant comprising a chlorine-free, fluorine-containing heat transfer fluid and a lubricant composition having a base oil component that comprises an alkylbenzene as a major component thereof and a polyol ester as a minor component thereof.

In a preferred embodiment of the invention the rotary vane compressor is a fixed-vane compressor.

Preferably the refrigerant is a hydrofluorocarbon and more preferably is selected from the group comprising difluoromethane (R-32), trifluoromethane (R-23), 1,1,2,2-tetrafluoroethane (R-134), 1,1,1,2-tetrafluoroethane (R-134a), 1,1,1-trifluoroethane (R-143a), 1,1-difluoroethane (R-152a) pentafluoroethane (R-125) and hexafluoroethane (R-116) and mixtures of two or more thereof. Particularly useful refrigerants are R-32, R-116, R125, R134a, R-143a and mixtures thereof.

Lubricant compositions according to the invention provide good lubrication, oil return and low start-up torque conditions at a relatively low cost as compared to the lubricant compositions used hitherto.

The invention will now be described further by way of example only with reference to the accompanying drawings and the following Examples.

IN THE DRAWINGS

Figure 1:
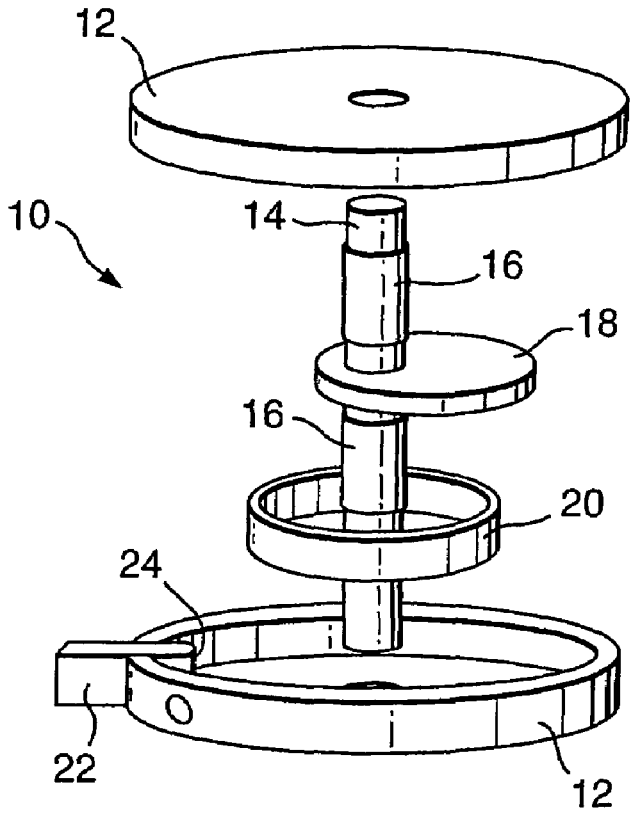
FIG. 1 shows a simplified exploded perspective view of a fixed-vane rotary compressor.

Referring to FIG. 1, the fixed-vane rotary compressor 10 has a cylindrical housing 12 in which is concentrically mounted a shaft 14 for rotation about an axis concentric with the housing 12. The shaft 14 has mounted between seals 16 a cam member 18. A cylindrical compression member 20 is located around the cam member 18 so that the shaft 14 through the cam member 18 rotates it. A fixed vane 22 is mounted in the periphery of the housing 12 and is resiliently biased to an inner position in which it protrudes into the housing. The vane 22, at its tip 24, engages with the outer surface of the compression member 20.

In operation, the rotation of the compression member 20 eccentrically within the housing 12 by the cam member 18 causes the vane 22 to move radially of the housing 12. Fluid entering the housing 12 through an inlet (not shown) is compressed between the vane 22 and the compression member 20 by rotation of the compression member 20. The compressed fluid passes through a valved or throttled outlet (not shown) in the housing adjacent the vane 22 immediately upstream of it relative to the direction of rotation of the compression member 20.

A lubricant composition is present in the compressor 10 to lubricate the Up 24 of the vane 22 as it contacts the outer surface of the compression member 20 and to lubricate the sides of vane 22 that are in sliding contact with the housing 12. The lubricant composition also lubricates other parts of the system such as bearings and, additionally, provides a satisfactory seal between the high-and low-pressure sides of the tip 24 of the vane 22 and the compression member 20.

EXAMPLE 1

The components of samples used for evaluation are set out in Table 1 and the samples used for evaluation are set out in Table 2.

TABLE 1

| No | |
|---|---|
| 1 | Is an alkylbenzene available from Chevron Company under the trade name Zerol 55. |
| 2A, 2B, 2C & 2D | Are samples of alkylbenzenes available from Chevron Company under the trade name Zerol 150. |
| 3 | Is an alkylbenzene containing a phosphate antiwear additive that is used in fixed-vane rotary compressors in combination with R22 (an HCFC) refrigerant. |
| 4A | Is a polyol ester made by reacting PE with linear $C_5$ monocarboxylic acid. |
| 4B | Is a polyol ester made by reacting PE with linear $C_5$ monocarboxylic acid. |
| 4C | Is a polyol ester made by reacting NPG with linear C7 acid (NPG nC7). |
| 4D | Is a polyol ester made by reacting a 50:50 mixture of PE and di-PE with linear C5, linear C7 and branched C9 acids (25:25:50). |

TABLE 1-continued

| No | |
|---|---|
| 5A | Is a polyol ester available from Japan Energy Corporation that is used in fixed-vane rotary compressors in combination with HFC refrigerants. |
| 5B | Is a polyol ester available from Japan Sunoil that is used in fixed-vane rotary compressors in combination with HFC refrigerants. |
| 6 | Is a PVE available from Idemitsu Kosan that is used in fixed-vane rotary compressors in combination with HFC refrigerants. |
| 7 | Is a mineral oil available from Japan Sunoil under the trade name SUNISO 4GS. |

In Table 2:

denotes comparative samples;

BHT is 3,5-dibutyl-4-hydroxytoluene, an antioxidant;

TCP is tricresyl phosphate, an antiwear additive; and the base oil components are expressed in wt % of that component and the additives are expressed in wt % based on the weight of the base oil component.

The properties of the samples are given in Table 3 in which:

*[1] The low temperature miscibility of each of the samples is determined by placing an accurately weighed portion of the Sample (approximately 0.6 g) into a sight glass, connecting the sight glass to a vacuum pump to evacuate it, cooling the sight glass using an acetone/drikold mixture and adding an accurately weighed portion of refrigerant (approximately 5.4 g). The portions of Sample and refrigerant equate to 10% lubricant compositionin refrigerant. The sight glass and its contents are then allowed to reach room temperature. If, upon examination of the contents of the sight glass, two or more phases are present, then the lubricant composition is immiscible with the refrigerant at room temperature and this fact is reported. If, upon examination of the contents of the sight glass, one phase is present, then the sight glass and its contents are cooled at a rate of approximately 1° C./5 minutes until the mixture goes cloudy, ie phase separation is beginning, and the cloud point temperature is reported.

*[2] IM=Immiscible.

TABLE 2

| No | Alkylbenzene | POE | PVE | Mineral Oil | Additives |
|---|---|---|---|---|---|
| 9 | 31.5% No 1 and 58.5% No 2A | 10% No 4A | | | 0.05% BHT |
| 10 | 90% No 2D | 10% No 4A | | | 0.05% BHT |
| 11 | 70% No 2D | 30% No 4C | | | 0.05% BHT |
| 12 | 70% No 2D | 30% No 4C | | | 3% TCP 0.05% BHT |
| 13A | 65% No 2B | 35% No 4C | | | 2.25% TCP 0.05% BHT |
| 13B | 65% No 2C | 35% No 4C | | | 2.25% TCP 0.05% BHT |
| 13C | 66% No 2C | 34% No 4C | | | |
| 13D | 65% No 2B | 35% No 4C | | | 3% TCP 0.05% BHT |
| 14A* | | 100% No 4B | | | 6% TCP 0.1% BHT |
| 14B* | | 100% No 4D | | | 6% TCP 0.1% BHT |
| 15A* | 100% No 2C | | | | |
| 15B* | 100% No 2D | | | | |
| 16* | 100% No 3 | | | | |
| 17* | | 100% No 5A | | | |
| 18* | | | 100% No 6 | | |
| 19* | | 100% No 5B | | | |
| 20* | | | | 100% No 7 | |

An alkylbenzene is a polymeric compound, having a distribution of molecular weights that can be characterised in a number of different ways. One such characterisation is number-average molecular weight (Mn). This is a normal counting type of molecular weight. Another way is the weight-average molecular weight (Mw), which enhances the higher end of the molecular weight distribution.

For Samples 2A, 2B and 2C, ie Zerol 150, the Mn and Mw are given below in Table 4.

TABLE 4

| Sample No | Mw | Mn |
|---|---|---|
| 2A | 379 | 440 |
| 2B | 362 | 400 |
| 2C | 380 | 351 |

In these samples, Mn and Mw are close in value, indicating that the samples have narrow molecular weight distributions.

The % molecular distributions of Samples 1, 2A, 2B and 2C are as shown in Table 5.

TABLE 5

| Sample No | MW < 200 | MW 200–300 | MW 301–350 | MW > 350 |
|---|---|---|---|---|
| 1 | 13 | 80 | 6 | 1 |
| 2A | <0.5 | 17 | 23 | 60 |

| | MW < 350 | MW 350–400 | MW 401–450 | MW 451–500 | MW > 500 |
|---|---|---|---|---|---|
| 2B | 22.3 | 16.5 | 18.3 | 14.4 | 28.5 |
| 2C | 42 | 20.7 | 14.7 | 11.2 | 11.4 |

Sample 2D has been used to denote samples of Zerol 150 alkylbenzenes for which the parameters in Tables 4 and 5 were not determined; however, those samples will have had similar molecular weights and molecular weight distributions to the other samples.

Samples 1 and 2A/B/C/D (Zerol 55 and Zerol 150, respectively) are branched alkylbenzenes, the chemical structure of which is likely to consist of the following molecular types.

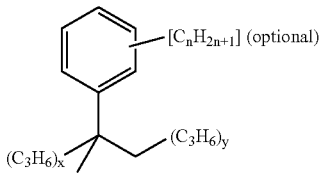

-continued

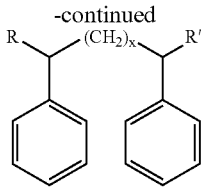

Sample 3 is a branched alkylbenzene that is likely to have a similar structure to Samples 1 and 2A/B/C/D.

EXAMPLE 2

Bench wear testing of Samples 13D and 16 to 18 has been performed according to ASTM standard D-4172 (four-ball method). The four-ball method consists of a rotating steel ball pressed against three other steel balls and is quantified by measurement of the diameter of the wear scar produced. The conditions of the test are 40 kg load for 1 hour, under an atmosphere of air. The diameter of the wear scar on the balls is a direct measure of the amount of wear. The smaller the wear scar, the better the lubricant composition at preventing wear under these conditions.

The results of the test are shown in Table 6.

TABLE 6

| | Sample No | | | |
|---|---|---|---|---|
| | 13D | 16 | 17 | 18 |
| Wear Scar (mm) | 0.642 | 1.77 | 1.047 | 0.605 |

This data demonstrates that the wear performance under these test conditions is comparable for Samples 13D (in accordance with the invention) and 18, both of which demonstrate significantly better wear than Samples 16 and 17.

TABLE 3

| | | Sample No | | | | | | | | | | |
|---|---|---|---|---|---|---|---|---|---|---|---|---|
| Property | Test Method | 1 | 2A | 2B | 3 | 4A | 4B | 4C | 4D | 5B | 6 | 7 |
| Viscosity (cSt) | ASTM D-445 | | | | | | | | | | | |
| 40° C. | | 5.7 | 33.5 | 31.3 | 48.2 | 15.2 | 15.5 | 5.6 | 72 | 65.4 | 67.8 | 54.7 |
| 100° C. | | 1.7 | 4.4 | 4.5 | | 3.6 | 3.6 | 1.9 | 9.8 | 8.2 | 8.4 | 6.1 |
| Viscosity Index | ASTM D-2270 | | 25 | 8 | | 121 | 115 | 167 | 120 | 91 | 91 | 25 |
| Pour Point (° C.) | ASTM D-97 | | −40 | | | −55 | | <−60 | −39 | −35 | −38 | |
| Flash Point COC (° C.) | ASTM D-92 | | 170 | | | 228 | | 184 | 270 | 274 | 194 | |
| Density at 20° C. (g/mL) | ASTM D-1298 | | 0.87 | | | 1.02 | | 0.93 | 0.98 | | 0.93 | |
| Acid Value (mgKOH/g) | ASTM D-974 | 0.02 | 0.02 | | 0.01 | 0.02 | | 0.01 | 0.02 | 0.01 | 0.01 | |
| Water Content (ppm) | ASTM D-1064 | <40 | | | | <40 | | <40 | <40 | | | |
| Colour (ASTM) | ASTM D-1209 | <0.5 | <0.5 | | <0.5 | <0.5 | | <0.5 | <0.5 | | <0.5 | |
| Low Temperature Miscibility (° C.) | In House*[1] | | | | | | | | | | | |
| 10% Lubricant in R-12 | | | <−73 | | | | | | | | | |
| 10% Lubricant in R-22 | | | −72 | | | | | | | | | |
| 10% Lubricant in R-134a | | | IM*[2] | | | | | −56 | | | −30 | |
| 10% Lubricant in R-404A | | | IM*[2] | | | | | | | | −50 | |
| 10% Lubricant in R-407C | | | IM*[2] | | | | | | | | −15 | |
| 4 Ball Wear Scar (mm) | ASTM D-2783 | | 1.67 | | | | | | | 1.02 | 0.99 | |

TABLE 3-continued

| | | | | | | | | | |
|---|---|---|---|---|---|---|---|---|---|
| 40 kg, 1 hour | | | | | | | | | |
| Falex Load to Fail (lb) | ASTM D-3233 | | 1500 | | | | | | 1800 |
| Falex (Wear Teeth) | ASTM D-1209 | | | | | | | 127 | |
| 5 hours, 400 lb, steel/steel in R-134a | | | | | | | | | |

| | | Sample No | | | | | | | |
|---|---|---|---|---|---|---|---|---|---|
| Property | Test Method | 9 | 10 | 11 | 12 | 13A | 13B | 13C | 13D |
| Viscosity (cSt) | ASTM D-445 | | | | | | | | |
| 40° C. | | 14.5 | 27.4 | 15.4 | 15.5 | 14.2 | 14.3 | 14.6 | 14.1 |
| 100° C. | | 2.9 | 4.3 | 3.2 | 3.24 | | | 3.1 | 3.1 |
| Viscosity Index | ASTM D-2270 | 11 | 16 | 55 | 55 | | | 50 | 53 |
| Pour Point (° C.) | ASTM D-97 | −42 | <−50 | −55 | −57 | <−50 | <−50 | | |
| Flash Point COC (° C.) | ASTM D-92 | 164 | 192 | | 179 | 195 | 190 | | |
| Density at 20° C. (g/mL) | ASTM D-1298 | | 0.88 | | 0.89 | 0.89 | 0.89 | | 0.89 |
| Acid Value (mgKOH/g) | ASTM D-974 | 0.02 | 0.01 | 0.02 | 0.03 | | | | 0.02 |
| Water Content (ppm) | ASTM D-1064 | <40 | <40 | <40 | <40 | <40 | <40 | <40 | <40 |
| Colour (ASTM) | ASTM D-1209 | <0.5 | 1–1.5 | 1–1.5 | 1–1.5 | | | | 1–1.5 |
| Low Temperature Miscibility (° C.) | In House*1 | | | | | | | | |
| 10% Lubricant in R-12 | | | | | | | | | |
| 10% Lubricant in R-22 | | | IM*2 | IM*2 | IM*2 | IM*2 | IM*2 | IM*2 | IM*2 |
| 10% Lubricant in R-134a | | | IM*2 | IM*2 | IM*2 | IM*2 | IM*2 | IM*2 | IM*2 |
| 10% Lubricant in R-404A | | | IM*2 | IM*2 | IM*2 | IM*2 | IM*2 | IM*2 | IM*2 |
| 10% Lubricant in R-407C | | | | | | | | | |
| 4 Ball Wear Scar (mm) | ASTM D-2783 | | | | 0.64 | 0.72 | 0.65 | | |
| 40 kg, 1 hour | | | | | | | | | |
| Falex Load to Fail (lb) | ASTM D-3233 | | | | 1900 | | | | |
| Falex (Wear Teeth) | ASTM D-1209 | | | | 17 | | | | |
| 5 hours, 400 lb, steel/steel in R-134a | | | | | | | | | |

EXAMPLE 3

Three types of miscibility behaviour may be observed, namely:

a) miscible at the lowest temperature in the system;

b) not miscible at some points but still soluble at all points in the system (partially miscible); and c) not miscible and not soluble at all points.

Sample 13D was measured to be immiscible at concentrations of at least 5% with HFC refrigerants at all temperatures below room temperature (21° C.). This will not significantly affect the performance provided either the lubricant composition is miscible at concentrations of around 2% (representative of the concentration of lubricant composition circulating in a refrigeration system) or there is sufficient solubility to enable oil return to the compressor.

EXAMPLE 4

Materials compatibility data was measured according to ASHRAE 97 sealed tube method. The test lubricant compositions were placed in autoclaves with samples of polyethylene terephthalate (PET—commonly used as an insulating material in electrical motors), polybutyl terephthalate (PBT—typically found in compressors), steel, aluminium and copper. The autoclaves were then sealed and evacuated to allow the addition of R-134a refrigerant. The proportion of refrigerant to lubricant composition is 50:50. The test conditions were 14 days at 130° C. and 400 psig pressure.

Lubricant composition analysis before and after the tests is shown in Table 7.

It can be observed that there is very little change in the condition of the lubricant compositions under these conditions, with the exception of the marked reduction in viscosity of Sample 17. There was no significant change in the condition of the test materials during this test.

TABLE 7

| | Viscosity (cPs) | | Acid Value (mgKOH/g) | | Colour (ASTM) | |
|---|---|---|---|---|---|---|
| Sample No | Before | After | Before | After | Before | After |
| 13D | 12.4 | 12.6 | 0.02 | 0.01 | 1–1.5 | 1–1.5 |
| 16 | 50.9 | 51.9 | 0.01 | 0.01 | <0.5 | <0.5 |
| 17 | 65.2 | 56.2 | 0.01 | 0.01 | <0.5 | <0.5 |
| 18 | 65.2 | 62.4 | 0.01 | 0.01 | <0.5 | <0.5 |

EXAMPLE 5

Thermal stability data was measured according to ASHRAE 97 sealed tube method. The test lubricant compositions were placed in autoclaves, which were sealed and evacuated to allow the addition of R-134a refrigerant. The proportion of refrigerant to lubricant composition is 50:50. The test conditions were 14 days at 175° C. and 600 psig pressure.

Analysis of the lubricant compositions before and after the tests is shown Table 8.

TABLE 8

| | Viscosity (cPs) | | Acid Value (mgKOH/g) | | Colour (ASTM) | |
|---|---|---|---|---|---|---|
| Sample No | Before | After | Before | After | Before | After |
| 13D | 12.4 | 13.0 | 0.02 | 0.02 | 1–1.5 | 1–1.5 |
| 16 | 50.9 | 48.1 | 0.01 | 0.01 | <0.5 | <0.5 |

TABLE 8-continued

| | Viscosity (cPs) | | Acid Value (mgKOH/g) | | Colour (ASTM) | |
|---|---|---|---|---|---|---|
| Sample No | Before | After | Before | After | Before | After |
| 17 | 65.2 | 65.0 | 0.01 | 0.01 | <0.5 | <0.5 |
| 18 | 65.2 | 58.7 | 0.01 | 0.01 | <0.5 | <0.5 |

Again, it can be observed that there is very little change in the condition of the lubricant compositions during this test, apart from a marked reduction in viscosity of Sample 18. This might be due to deterioration of the lubricant composition of Sample 18 under the higher temperature conditions of this test compared to the materials compatibility test in Example 4.

EXAMPLE 6

In an alternative test, samples of the lubricant compositions were heated in a glass vessel at 120° C. for 7 days under a stream of dry nitrogen. The condition of the lubricant compositions was measured before and after the test. The results are given in Table 9.

The only significant result from this test is the increase in acid value observed with Samples 17 and 18. The Samples 13 and 16 show physical properties virtually unchanged from the virgin lubricant compositions.

TABLE 9

| Sample No | Moisture (ppm) | Viscosity @ 40° C. (cSt) | Acid Value (mgKOH/g) | Colour (Hazen) |
|---|---|---|---|---|
| | | Analysis before Testing | | |
| 13D | 17 | 14.0 | 0.017 | 346 |
| 16 | 0 | 55.1 | 0.006 | 86 |
| 17 | 3 | 66.5 | 0.003 | 44 |
| 18 | 24 | 69.3 | 0.011 | 13 |
| | | Analysis After Testing | | |
| 13D | 38 | 14.0 | 0.009 | 394 |
| 16 | 20 | 55.1 | 0.006 | 127 |
| 17 | 20 | 66.3 | 0.008 | 57 |
| 18 | 61 | 69.6 | 0.025 | 73 |

EXAMPLE 7

Hygroscopicity (the uptake of moisture from the atmosphere) is important because the lubricant compositions will be handled in air for short periods of time and therefore have the ability to increase in moisture content above the levels at which they are commonly supplied. Many air-conditioning system manufacturers are preferring to omit the in-line drier, which acts as an 'insurance' against moisture ingress, due to cost considerations. The presence of levels above 100 ppm in a refrigeration or air-conditioning system is considered detrimental to reliability due to possible interactions with the PET motor wire-winding insulation leading to degradation and motor failure. Therefore, the less a lubricant composition absorbs moisture from the atmosphere, the less likely a level of moisture is reached in the system that may lead to these potential failures.

To measure the hygroscopicity of the lubricants the following technique was used. The samples were dried using a dry nitrogen sparge and the initial moisture recorded. The dry lubricant composition was filled into a 100 ml wide-necked bottle, which was placed into a desiccator containing a saturated sodium chloride solution. The desiccator was sealed and left at room temperature (21° C.). Moisture readings on the lubricant composition samples were taken every 30 minutes for the first 3 hours and then every hour until 6 hours had elapsed.

Each moisture result is an average of three readings. The results are shownin Table 10.

Figure 2:
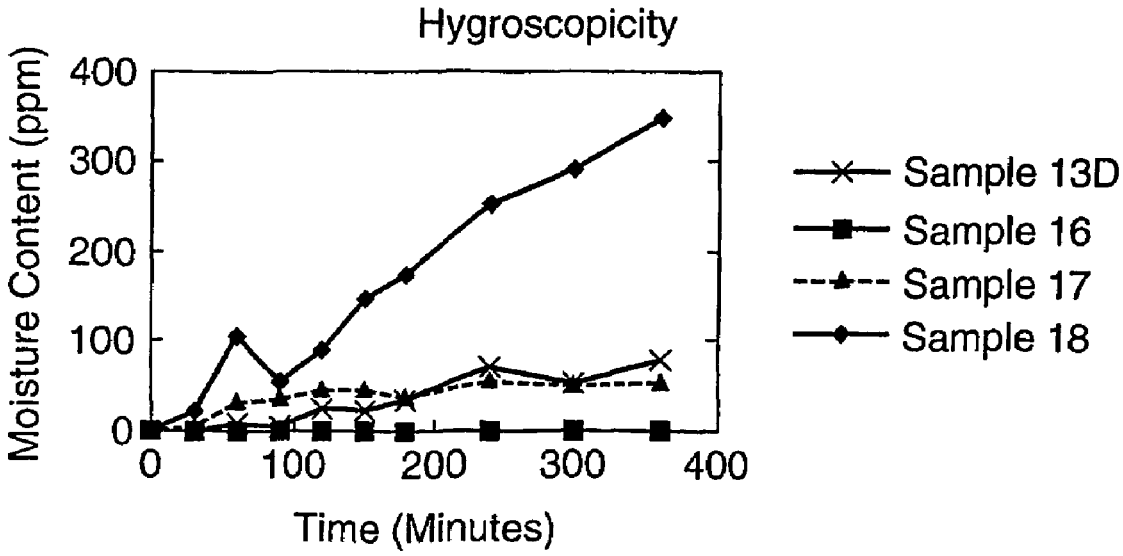
FIG. 2 is a graphical representation of the results obtained in Example 7.

The results of this test have been plotted and are shown in FIG. 2.

EXAMPLE 8

Lubricant compositions were evaluated by charging Tecumseh Europe RK5515 fixed-vane rotary compressors with the relevant sample and appropriate refrigerant gas connected in line with other components of a refrigeration system.

The test conditions are shown in Table 11.

The compressors are operated at these conditions for 2000 hours and then stripped down for analysis of the wear on metal components.

TABLE 10

| | Moisture Content (ppm) | | | |
|---|---|---|---|---|
| Time (mins) | Sample 13D | Sample 16 | Sample 17 | Sample 18 |
| 0 | 0 | 0 | 0 | 0 |
| 30 | 6 | 0 | 0 | 21 |
| 60 | 32 | 0 | 8 | 105 |
| 90 | 36 | 0 | 6 | 55 |
| 120 | 45 | 0 | 24 | 89 |
| 150 | 47 | 0 | 22 | 148 |
| 180 | 38 | 0 | 33 | 173 |
| 240 | 57 | 0 | 70 | 252 |
| 300 | 53 | 0 | 52 | 291 |
| 360 | 54 | 0 | 79 | 349 |

TABLE 11

| Refrigerant | Suction Pressure (psig) | Discharge Pressure (psig) | Motor Winding Temperature (° C.) |
|---|---|---|---|
| R-22 | 93 | 415 | 130 |
| R-407C | 86 | 470 | 130 |

Compressor Test Wear Rating Evaluation is determined using the following criteria to score the components of the compressor following the test and dismantling the compressor for examination.

| Rating | Description |
|---|---|
| 0 | No change, no marking or visible signs of wear |
| 1 | Low wear, evidence of light polishing over a small area |
| 2 | Moderate wear, light scratching or polishing. The surface treatment may be worn away in a localised area |
| 3 | Marked wear, the surface may be worn away in an area. Wear may be observed as light scratching. This will be felt as a slight roughness if a point is drawn across the surface. |
| 4 | High wear, the surface will show clear scratches in the wear zone. The wear will be apparent and a point drawn across will feel rough, possibly with steps. |
| 5 | Very high wear, extensive wear in the loaded area. A wear step will be felt between the surface and the virgin metal. Fracture and seizure included |

Compressor Test Results

A total wear figure is obtained by analysing the wear at 15 separate points. However, the wear figures at the outer surface of the compression member 20 and the vane tip 24 as shown in FIG. 1 are the crucial figures to consider in determining whether the wear taking place in the compressor is considered to be acceptable or not. In terms of the Compressor Test Wear Rating Evaluation, an average of 3 on those two locations is considered to be on the boundary of acceptability.

The results are shown in Table 12.

TABLE 12

| | | Wear Scores | | |
|---|---|---|---|---|
| Sample No | Refrigerant | Vane Tip 24 | Comp M 20 | Total |
| 9 | R-407C | 3 | 3 | 17.5 |
| 10 | R-407C | 2.5 | 4.5 | 31 |
| 11 | R-407C | 2.5 | 2.5 | 24 |
| 12 | R-407C | 1 | 2 | 14 |
| 14B | R-407C | 5 | 5 | 37 |
| 15B | R-407C | 2 | 3 | 28 |
| 16 | R-22 | 3.5 | 4.5 | 40 |

As can be seen from these results, lubricant compositions according to the invention minimise the wear on the components of the compressor.

EXAMPLE 9

Lubricant compositions 13D and 18 were evaluated by charging Tecumseh Europe RK5515 fixed-vane rotary compressors with the relevant sample and refrigerant gas R407C connected in line with other components of a refrigeration system.

The test conditions are shown in Table 13. For the On/Off test, an automatic switch was used to switch the compressor on for 15 seconds and then off for 15 seconds.

The compressors are operated at those conditions for the cycles/times indicated and then stripped down for analysis of the wear on metal components. The results of the analysis are shown in Table 14.

TABLE 13

| Test | Test Type | Suction Pressure (psig) | Discharge Pressure (psig) | Motor Winding Temperature (° C.) |
|---|---|---|---|---|
| 1 | On/Off 125000 cycles | 96 | 556 | 100 ± 5 |
| 2 | 500 hours | 96 | 556 | 88 ± 3 |
| 3 | 500 hours | 13 | 320 | 88 ± 3 |

TABLE 14

| | | Wear Scores | |
|---|---|---|---|
| Test No | Sample No | Vane Tip 24 | Comp M 20 |
| 1 | 13D | 0.5 | 0.5 |
| 2 | 13D | 0.5 | 0.5 |
| 3 | 13D | 0.5 | 0.5 |
| 1 | 18 | 1 | 1 |
| 2 | 18 | 1 | 1 |
| 3 | 18 | 1.5 | 2 |

The tests simulated a variety of operating conditions namely cycling on and off (Test 1) and different refrigeration circuit operating temperatures (Test 2—high temperature; Test 3—low temperature). As can be seen from Table 14, the lubricant composition 13D according to the invention performed significantly better than the comparative composition 18.

EXAMPLE 10

Example 9 was repeated using Guangdong Meizhi Compressor Co, PRC PH225X2C compressors and samples 13A and 19 under the operating conditions shown in Table 15. The results are shown in Table 16 from which it can be seen the lubricant composition 13A according to the invention performed significantly better than the comparative composition 19.

TABLE 15

| Test Type | Suction Pressure (psig) | Discharge Pressure (psig) | Motor Winding Temperature (° C.) |
|---|---|---|---|
| 500 hours | 96 | 556 | 85 |

TABLE 16

| | Wear Scores | |
|---|---|---|
| Sample No | Vane Tip 24 | Comp M 20 |
| 13A | 0.5 | 0.5 |
| 19 | 1 | 1 |

EXAMPLE 11

The start-up voltage required to start the motor driving a compressor is preferably minimised over the normal case temperature operating range (typically in the range 40° C. to 60° C.) to minimise energy consumption and to reduce electrical stress on the motor thereby improving reliability. The start-up voltage at various case temperatures using samples of lubricant compositions in combination with different refrigerant gases was determined by increasing the voltage supplied to the motors until the motor start to turn. The start-up voltage was measured twice for each combination. The results are shown in Table 17 and in FIGS. 3 and 4.

TABLE 17

| | Motor Winding | Sample/Start-up Voltage (V) | | | |
|---|---|---|---|---|---|
| Refrigerant | Temperature (° C.) | 13B | 18 | 19 | 15A |
| R-407C | 30 | 128 | 125 | 130 | 133 |
| R-407C | 40 | 133 | 140 | 140 | 136 |
| R-407C | 50 | 137 | 157 | 150 | 142 |
| R-407C | 60 | 143 | 163 | 160 | 151 |
| R-404 | 30 | 133 | 132 | 134 | |
| R-404 | 40 | 134 | 134 | 136 | |
| R-404 | 50 | 135 | 136 | 138 | |
| R-404 | 60 | 136 | 138 | 140 | |

Figure 3:
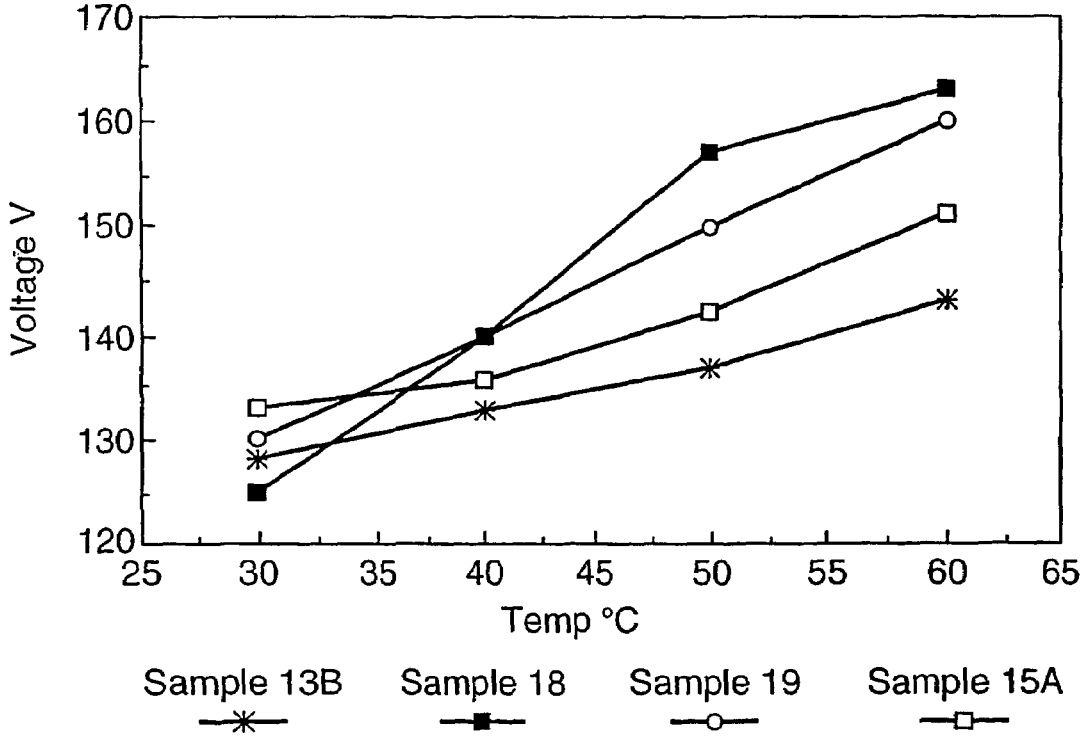
FIGS. 3 and 4 are graphical representations of the results obtained in Example 11.
Figure 4:
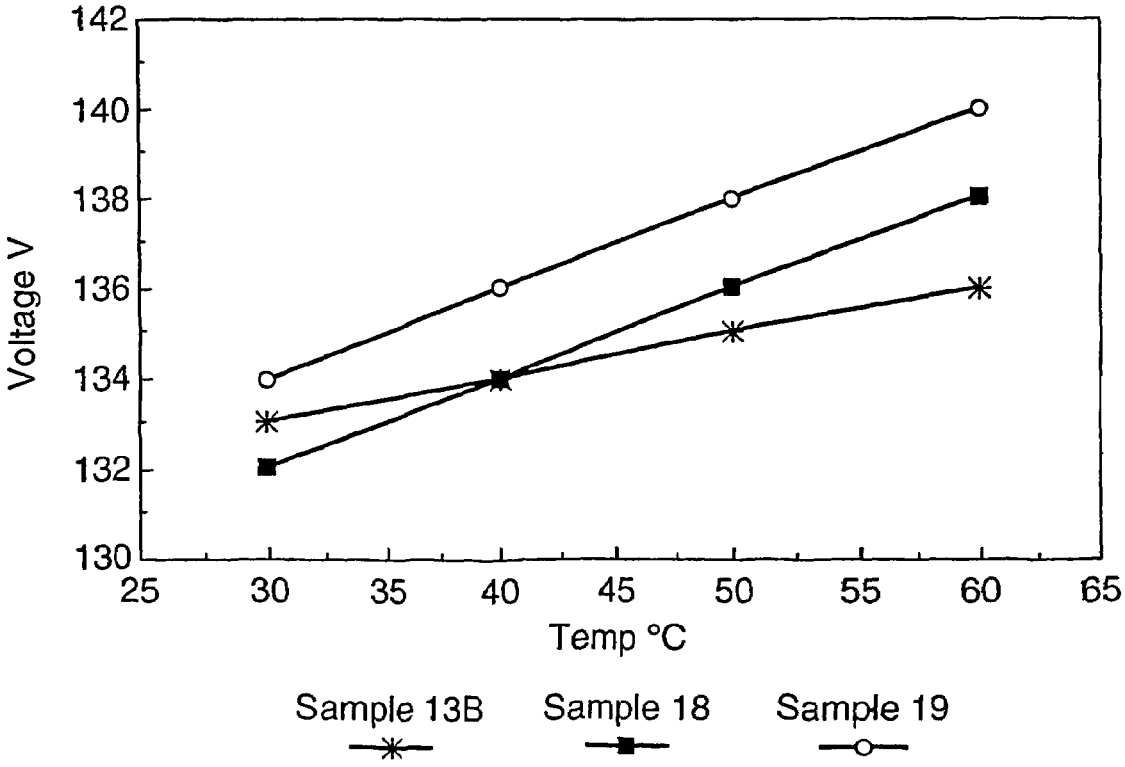

As can be seen from Table 17 and FIGS. 3 (which plots the R407C refrigerant results) and 4 (which plots the R-404 refrigerant results), Sample 13B in accordance with the invention results in lower start-up voltages being required by the compressor motors than the comparative Samples over the normal case temperature operating range.

EXAMPLE 12

In a refrigeration system, it is not possible to eliminate carry over of lubricant composition from the compressor into other parts of the circuit. Consequently, it is important that the lubricant composition is transported efficiently through the refrigeration circuit back to the compressor. To test the transportability of lubricant compositions, approximately 10 g of lubricant composition was accurately weighted and then poured into one end of a horizontally disposed coiled copper tube (internal diameter of tube—6.3 mm, internal diameter of coil-93 mm; and length of tube—2.5 m). Refrigerant gas R-134a was then blown through the tube from the end into which the lubricant composition was introduced at a rate of 18 liters/minute for 15 minutes. Lubricant composition transported through the tube by the refrigerant gas flow was collected at the exit end of the tube. The collected lubricant composition was warmed gently to drive off any dissolved refrigerant gas and allowed to cool to ambient temperature before the amount of lubricant composition collected was accurately weighed. A number of runs for each lubricant composition were made and the results are shown in Table 18.

TABLE 18

| Sample No | % Lubricant Transported |
|---|---|
| 15A | 47/38/46 |
| 14A | 75/70 |
| 13C | 68/70 |
| 20 | 45/46/46 |

As can be seen from Table 18, the test correlates reasonably with reality in that mineral oil (Sample 20) and alkylbenzene (Sample 15A) transports through a refrigeration system poorly when the refrigerant is an HFC and polyol esters (Sample 4) transport through a refrigeration system well when the refrigerant is an HFC. Lubricant compositions in accordance with the invention (Sample 13C) compare favourably with polyol esters (Sample 14A).

The invention claimed is:

1. A lubricant composition comprising alkyl benzene and at least 25% by weight polyol ester, wherein the alkyl benzene has a molecular distribution in which at least 50% of the molecular weight fraction is greater than 350.

2. A lubricant composition according to claim 1 in which the base oil component comprises at least 55% by weight of alkylbenzene and at most 45% by weight of a polyol ester.

3. A lubricant composition according to claim 1 in which the base oil component consists essentially of alkylbenzene and polyol ester.

4. A lubricant composition according to claim 1 in which the alkylbenzene component is selected from the group consisting of mono-alkylbenzenes, di-alkylbenzenes, di-phenylalkanes and mixtures thereof.

5. A lubricant composition according to claim 1 in which the alkylbenzene component has a molecular distribution in which at least 80% of the molecular weight fraction is greater than 200.

6. A lubricant composition according to claim 1 in which the alkylbenzene component has a molecular distribution in which at least 70% of the molecular weight fraction is below 500.

7. A lubricant composition according to claim 1 in which the alkylbenzene component has a kinematic viscosity of at least 10 cSt, but not more than 70 cSt at 40° C. and a kinematic viscosity of at least 2 cSt, but not more than 10 cSt at 100° C.

8. A lubricant composition according to claim 1 in which the alkylbenzene component has a pour point of less than −10° C.

9. A lubricant composition according to claim 1 in which the alkylbenzene component has an acid number of less than 0.04 mgKOH/g.

10. A lubricant composition according to claim 1 in which the polyol ester component comprises at least one polyol ester that is a reaction product of a polyhydric alcohol and a monobasic carboxylic acid.

11. A lubricant composition according to claim 1 in which the polyol ester component is at least one polyol ester that is a reaction product of one or more alcohols selected from neopentylglycol (NPG), trimethylol-propane (TMP) and pentaerythritol (PE) and dimers and trimers thereof and one or more acids selected from linear and/or branched $C_5$ to $C_{18}$ acids.

12. A lubricant composition according to claim 1 in which the polyol ester component has a kinematic viscosity of at least 5 cSt but not more than 40 cSt and a kinematic viscosity of at least 1.5 cSt but not more than 5 cSt at 100° C.

13. A lubricant composition according to claim 1 in which the polyol ester component has a pour point of less than −40° C.

14. A lubricant composition according to claim 1 in which the polyol ester component has an acid number of less than 0.04 mgKOH/g.

15. A lubricant composition according to claim 1 which has a kinematic viscosity of at least 5 cSt but not more than 40 cSt at 40° C. and a kinematic viscosity of at least 2 cSt but not more than 6 cSt at 100° C.

16. A lubricant composition according to claim 1 which has a pour point of not more than −40° C.

17. A lubricant composition, according to claim 1 which comprises one or more lubricant additives selected from antioxidants, anti-wear additives, extreme pressure agents, acid scavengers, foaming agents, anti-foaming agents, stabilisers, surfactants, viscosity index improvers, corrosion inhibitors, metal deactivators or passivators, lubricity improvers or oiliness agents and friction modifiers at levels between 0.0001 and 20 weight % based on the weight of the base oil component.

18. A method of lubricating a rotary vane compressor comprising charging the compressor with a lubricant composition as defined in claim 1.

19. A rotary vane compressor charged with a lubricant composition as defined in claim 1.

20. A refrigeration system comprising a rotary vane compressor, said system being charged with a refrigerant comprising a chlorine-free, fluorine-containing heat transfer fluid and a lubricant composition as defined in claim 1.

21. A refrigeration system according to claim 20 in which the refrigerant is a hydrofluorocarbon.

22. A refrigeration system according to claim 21 in which the refrigerant is selected from the group comprising R-32, R-116, R-125, R134a, R-143a and mixtures thereof.

23. The method of claim 18 wherein, the rotary vane compressor is a fixed-vane compressor.

24. A refrigeration system according to claim 20 in which the refrigerant is selected from the group comprising difluoromethane (R-32), trifluoromethane (R-23), 1,1,2,2-tetrafluoroethane (R-134), 1,1,1,2-tetrafluoroethane (R-134a), 1,1,1-trifluoroethane (R-143a), 1,1-difluoroethan (R-152a)

pentafluoroethane (R-125) and hexafluoroethane (R-116) and mixtures of two or more thereof.

25. A lubricant composition according to claim 1 in which the base oil component comprises at least between 60% and 75% by weight of alkyl benzene and between 40% and 25% by weight of polyol ester.

26. The lubricant composition according to claim 1 in which the alkylbenzene component has a molecular distribution in which at least 50% of the molecular weight fraction is below 450.

27. The lubricant composition according to claim 1 in which the alkylbenzene component has a kinematic viscosity of at least 25 cSt, but not more than 70 cSt at 40° C. and a kinematic viscosity of at least 3.5 cSt, but not more than 10 cSt at 100° C.

28. The lubricant composition according to claim 1 in which the alkylbenzene component has a pour point of less than −30° C.

29. The lubricant composition according to claim 1, wherein the alkyl benzene includes an alkyl component that is branched.

30. The lubricant composition according to claim 1, in which the polyol ester component comprises at least one polyol ester that is a reaction product of a polyhydric alcohol and one or more acids selected from linear and/or branched $C_5$ to $C_9$ acids.

31. The lubricant composition according to claim 1, wherein the polyol ester has a kinematic viscosity of at least 5 cSt and no more than 25 cSt at 40° C., and a kinematic viscosity of at least 1.5 cSt and no more than 4 cSt at 100° C.

32. The lubricant composition according to claim 1, wherein the polyol ester component has a pour point of less than −55° C.

33. The lubricant composition according to claim 1, wherein the composition has a kinematic viscosity of at least 5 cSt and no more than 25 cSt at 40° C. and a kinematic viscosity of at least 2 cSt and no more than 5 cSt at 100° C.

* * * * *